US010352105B2

(12) United States Patent
Bao et al.

(10) Patent No.: US 10,352,105 B2
(45) Date of Patent: Jul. 16, 2019

(54) SINTERING OF THICK SOLID CARBONATE-BASED PCD FOR DRILLING APPLICATION

(71) Applicant: Smith International, Inc., Houston, TX (US)

(72) Inventors: Yahua Bao, Provo, UT (US); Anatoliy Garan, Provo, UT (US); Michael David France, Lehi, UT (US); John Daniel Belnap, Provo, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 72 days.

(21) Appl. No.: 15/276,183

(22) Filed: Sep. 26, 2016

(65) Prior Publication Data

US 2017/0122038 A1 May 4, 2017

Related U.S. Application Data

(62) Division of application No. 14/079,689, filed on Nov. 14, 2013, now Pat. No. 9,475,176.

(60) Provisional application No. 61/726,707, filed on Nov. 15, 2012.

(51) Int. Cl.

| | |
|---|---|
| ***B24D 3/00*** | (2006.01) |
| ***B24D 18/00*** | (2006.01) |
| ***E21B 10/567*** | (2006.01) |
| ***E21B 10/46*** | (2006.01) |
| ***B24D 3/04*** | (2006.01) |
| *B24D 3/02* | (2006.01) |
| *B24D 11/00* | (2006.01) |
| *C09K 3/14* | (2006.01) |

(52) U.S. Cl.
CPC ..... *E21B 10/567* (2013.01); *B24D 3/04* (2013.01); *B24D 18/0009* (2013.01); *E21B 10/46* (2013.01)

(58) Field of Classification Search
USPC ..... 51/293, 307, 309
See application file for complete search history.

(56) References Cited

U.S. PATENT DOCUMENTS

| | | | |
|---|---|---|---|
| 4,604,106 | A | 8/1986 | Hall |
| 4,766,040 | A | 8/1988 | Hillert et al. |
| 5,510,193 | A | 4/1996 | Cerutti et al. |
| 5,645,617 | A | 7/1997 | Frushour |
| 5,848,348 | A | 12/1998 | Dennis |
| 6,432,150 | B1 | 8/2002 | Levashov et al. |

(Continued)

OTHER PUBLICATIONS

Akaishi et al. (Synthesis of Polycrystalline Diamond Compact with Magnesium Carbonate and it Physical Properties, Diamond and Related Materials 5 (1996), 2-7, as supplied by applicants) (Year: 1996).*

(Continued)

*Primary Examiner* — James E McDonough

(57) ABSTRACT

A method of making a polycrystalline diamond compact includes forming multiple layers of premixed diamond particles and carbonate material, where the carbonate material includes an alkaline earth metal carbonate, and where each layer has a weight percent ratio of diamond to carbonate that is different from adjacent layers. The layers are subjected to high pressure high temperature conditions to form polycrystalline diamond.

13 Claims, 10 Drawing Sheets

(56) References Cited

U.S. PATENT DOCUMENTS

| | | | | |
|---|---|---|---|---|
| 7,635,035 | B1 * | 12/2009 | Bertagnolli | B32B 9/00 175/434 |
| 8,080,071 | B1 | 12/2011 | Vail | |
| 8,091,655 | B2 | 1/2012 | Shen et al. | |
| 8,702,825 | B2 | 4/2014 | Shen et al. | |
| 8,902,825 | B2 | 4/2014 | Shen et al. | |
| 2005/0050801 | A1 * | 3/2005 | Cho | B22F 7/008 51/293 |
| 2008/0206576 | A1 | 8/2008 | Qian et al. | |
| 2009/0273224 | A1 | 11/2009 | Hall | |
| 2010/0242375 | A1 | 9/2010 | Hall et al. | |
| 2011/0023375 | A1 | 2/2011 | Sani et al. | |
| 2011/0061942 | A1 | 3/2011 | Digiovanni | |
| 2011/0241266 | A1 | 10/2011 | Wardoyo et al. | |
| 2011/0252713 | A1 | 10/2011 | Chakraborty et al. | |
| 2012/0102843 | A1 | 5/2012 | Chakraborty et al. | |
| 2012/0103696 | A1 | 5/2012 | DiGiovanni | |
| 2012/0125696 | A1 | 5/2012 | Belnap et al. | |
| 2012/0181090 | A1 | 7/2012 | Qian et al. | |
| 2012/0241224 | A1 * | 9/2012 | Qian | B22F 5/00 175/428 |
| 2012/0261197 | A1 | 10/2012 | Miess et al. | |
| 2013/0015000 | A1 | 7/2013 | Zhang et al. | |
| 2014/0131117 | A1 | 5/2014 | Bao et al. | |

OTHER PUBLICATIONS

International Search Report and Written Opinion issued in PCT/US2013/070233 dated Mar. 20, 2011 (13 pages).

Narayan, "Adhesion Properties of Functionally Gradient Diamond Composite Films on Medical and Tool Alloys", Journal of Adhesion Science and Technology, 18:2 (2004) 1339-1365.

Akaishi, et al, "Synthesis of Polycrystalline Diamond Compact With Magnesium Carbonate and It's Physical Properties", Diamond and Related Materials 5 (1996) 2-7.

Qian, et al., "Polycrystalline Diamond Cutters Sintered With Magnesium Carbonate in Cubic Anvil Press", Int. Journal of Refractory Metals and Hard Materials 31 (2012) 71-75.

International Preliminary Report on Patentability issued in International Patent application PCT/US2013/070233, dated May 19, 2015, 9 pages.

* cited by examiner

SINTERING OF THICK SOLID CARBONATE-BASED PCD FOR DRILLING APPLICATION

CROSS REFERENCE OF RELATED APPLICATIONS

This application is a divisional application U.S. patent application Ser. No. 14/079,689, filed on Nov. 14, 2013, which claims the benefit of U.S. Provisional Patent Application No. 61/726,707, filled on Nov. 15, 2012, which are incorporated by reference.

BACKGROUND

Polycrystalline diamond ("PCD") materials and PCD elements formed therefrom are well known in the art. Conventional PCD may be formed by subjecting diamond particles in the presence of a suitable solvent metal catalyst material to processing conditions of high pressure/high temperature (HPHT), where the solvent metal catalyst promotes desired intercrystalline diamond-to-diamond bonding between the particles, thereby forming a PCD structure. The resulting PCD structure produces enhanced properties of wear resistance and hardness, making such PCD materials extremely useful in aggressive wear and cutting applications where high levels of wear resistance and hardness are desired. FIG. 1 illustrates a microstructure of conventionally formed PCD material 10 including a plurality of diamond grains 12 that are bonded to one another to form an intercrystalline diamond matrix first phase. The catalyst/binder material 14, e.g., cobalt, used to facilitate the diamond-to-diamond bonding that develops during the sintering process is dispersed within the interstitial regions formed between the diamond matrix first phase. The term "particle" refers to the powder employed prior to sintering a superabrasive material, while the term "grain" refers to discernable superabrasive regions subsequent to sintering, as known and as determined in the art.

The catalyst/binder material used to facilitate diamond-to-diamond bonding can be provided generally in two ways. The catalyst/binder can be provided in the form of a raw material powder that is pre-mixed with the diamond grains or grit prior to sintering. In other methods, the catalyst/binder can be provided by infiltration into the diamond material (during high temperature/high pressure processing) from an underlying substrate material that the final PCD material is to be bonded to. After the catalyst/binder material has facilitated the diamond-to-diamond bonding, the catalyst/binder material is generally distributed throughout the diamond matrix within interstitial regions formed between the bonded diamond grains. Particularly, as shown in FIG. 1, the binder material 14 is not continuous throughout the microstructure in the conventional PCD material 10. Rather, the microstructure of the conventional PCD material 10 may have a uniform distribution of binder among the PCD grains. Thus, crack propagation through conventional PCD material will often travel through the less ductile and brittle diamond grains, either transgranularly through diamond grain/binder interfaces 15, or intergranularly through the diamond grain/diamond grain interfaces 16.

Solvent catalyst materials may facilitate diamond intercrystalline bonding and bonding of PCD layers to each other and to an underlying substrate. Solvent catalyst materials used for forming conventional PCD include metals from Group VIII of the Periodic table, such as cobalt, iron, or nickel and/or mixtures or alloys thereof, with cobalt being the most common. Conventional PCD may include from 85 to 95% by volume diamond and a remaining amount of the solvent catalyst material. However, while higher metal content increases the toughness of the resulting PCD material, higher metal content also decreases the PCD material hardness, thus limiting the flexibility of being able to provide PCD coatings having desired levels of both hardness and toughness. Additionally, when variables are selected to increase the hardness of the PCD material, brittleness also increases, thereby reducing the toughness of the PCD material.

PCD is commonly used in earthen drilling operations, for example in cutting elements used on various types of drill bits. Although PCD is extremely hard and wear resistant, PCD cutting elements may still fail during normal operation. Failure may occur in three common forms, namely wear, fatigue, and impact cracking. The wear mechanism occurs due to the relative sliding of the PCD relative to the earth formation, and its prominence as a failure mode is related to the abrasiveness of the formation, as well as other factors such as formation hardness or strength, and the amount of relative sliding involved during contact with the formation. Excessively high contact stresses and high temperatures, along with a very hostile downhole environment, also tend to cause severe wear to the diamond layer. The fatigue mechanism involves the progressive propagation of a surface crack, initiated on the PCD layer, into the material below the PCD layer until the crack length is sufficient for spalling or chipping. Lastly, the impact mechanism involves the sudden propagation of a surface crack or internal flaw initiated on the PCD layer, into the material below the PCD layer until the crack length is sufficient for spalling, chipping, or catastrophic failure of the cutting element.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a method of making a polycrystalline diamond compact that includes forming multiple layers of premixed diamond particles and carbonate material, where the carbonate material includes an alkaline earth metal carbonate, and where each layer has a weight percent ratio of diamond to carbonate that is different from (e.g., between) adjacent layers, and subjecting the layers to high pressure high temperature conditions.

In another aspect, embodiments of the present disclosure relate to a polycrystalline diamond construction that includes a polycrystalline diamond body made of a plurality of bonded together diamond grains forming a matrix phase, a plurality of interstitial regions interposed between the bonded together diamond grains, and a carbonate material disposed within the interstitial regions, where the carbonate material includes an alkaline earth metal carbonate.

In yet another aspect, embodiments of the present disclosure relate to a downhole tool that has a body, a plurality of blades extending from the body, and at least one polycrystalline diamond cutting element disposed on the plurality of blades, where the polycrystalline diamond cutting element has a polycrystalline diamond body made of a plurality of bonded together diamond grains forming a matrix phase, a plurality of interstitial regions interposed between the bonded together diamond grains, and a carbonate material disposed within the interstitial regions, where the carbonate material includes an alkaline earth metal carbonate, and where the body also has a height measured between a working surface and a non-working surface, and the height is greater than 4 mm.

Other aspects and advantages of the claimed subject matter will be apparent from the following description and the appended claims.

BRIEF DESCRIPTION OF DRAWINGS

Embodiments of the present disclosure are described with reference to the following figures. The same numbers are used throughout the figures to reference like features and components.

DETAILED DESCRIPTION

As used herein, the term carbonate-based polycrystalline diamond refers to the resulting material produced by subjecting individual diamond particles in the presence of a carbonate material to sufficiently high pressure high temperature (HPHT) conditions that causes intercrystalline bonding to occur between adjacent diamond crystals to form a network or matrix phase of diamond-to-diamond bonding and a plurality of interstitial regions dispersed between the bonded together diamond grains. Carbonate-based polycrystalline diamond of the present disclosure may be referred to as polycrystalline diamond or PCD, but is distinguished from conventionally formed polycrystalline diamond (described in the background section) formed with a transition metal solvent catalyst.

According to embodiments of the present disclosure, a carbonate-based polycrystalline diamond body may have a microstructure including a matrix phase of a plurality of bonded together diamond grains with a plurality of interstitial regions interposed between the bonded together diamond grains and a carbonate material disposed within the interstitial regions, where the carbonate material includes (e.g., is selected from) an alkaline earth metal carbonate or from a combination of an alkali metal carbonate and an alkaline earth metal carbonate. In carbonate-based polycrystalline diamond material of the present disclosure, inclusion of a transition metal catalyst, silicon, and/or a silicon-containing compound is not necessary for formation of diamond-to-diamond bonds, and thus the carbonate-based polycrystalline diamond bodies may not contain such materials.

Figure 1:
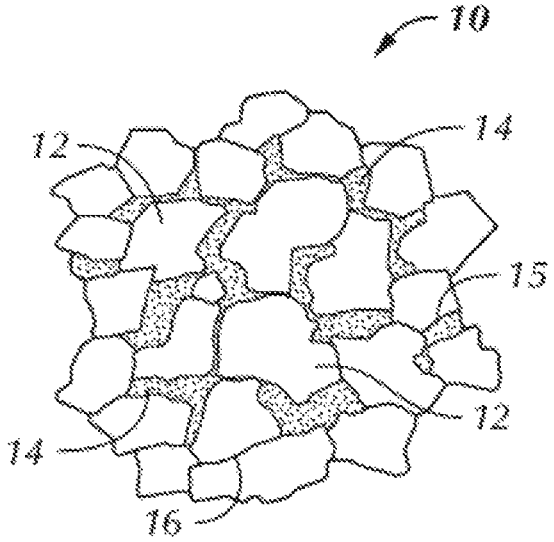
FIG. 1 Prior Art
FIG. 1 shows the microstructure of conventionally formed polycrystalline diamond.
Figure 2:
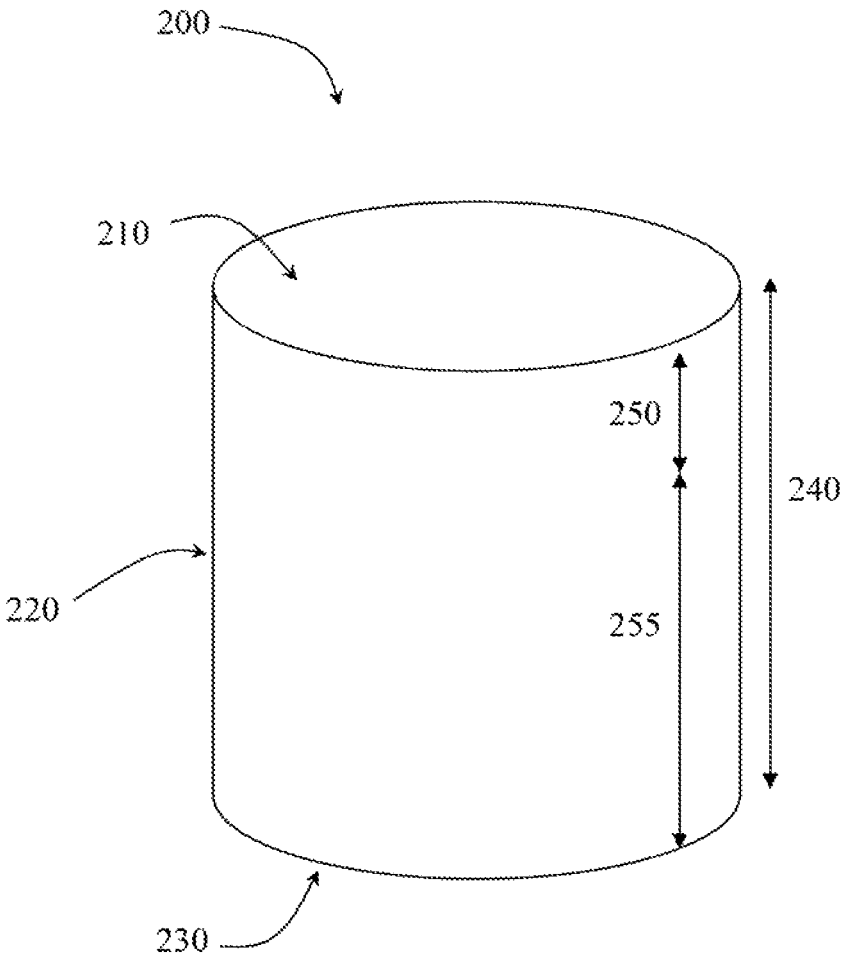
FIG. 2 shows a carbonate-based polycrystalline diamond body according to embodiments of the present disclosure.

FIG. 2 shows a polycrystalline diamond body according to some embodiments of the present disclosure. The body 200 has a working surface 210, an outer side surface 220, and a non-working surface 230, where a height 240 is measured between the working surface 210 and the non-working surface 230. According to some embodiments, the height may be greater than 2 mm, in some embodiments, the height may be greater than 4 mm, and in some embodiments, the height may be greater than 6 mm. As used herein, a working surface may refer to an outer surface of a polycrystalline diamond body that contacts and cuts a workpiece or earthen formation. However, because polycrystalline diamond bodies of the present disclosure include a solid polycrystalline diamond material (e.g., a substrate does not need to be attached), a polycrystalline diamond body of the present disclosure may be rotated to have more than one surface act as a working surface at various positions. Accordingly, a working surface may be different outer surfaces of a polycrystalline diamond body of the present disclosure depending on the positioning of the polycrystalline diamond body in relation to the formation being cut. The working surface 210 shown in FIG. 2 is shown as being a top surface of the body 200, while the non-working surface 230 is shown as being a bottom surface of the body 200. However, upon rotation of the body, the non-working surface may then act as the working surface and vice versa. Thus, the height 240 of a polycrystalline diamond body according to the present disclosure may be measured between opposite outer surfaces of the body, where one of the surfaces acts as a working surface at the time of measuring. Further, the body 200 shown in FIG. 2 has a cylindrical shape. However, carbonate-based polycrystalline diamond material of the present disclosure may be formed into other shapes, such as a rectangular or triangular prism.

As described above, the polycrystalline diamond body has a matrix phase of a plurality of bonded together diamond grains with a plurality of interstitial regions interposed between the bonded together diamond grains and one or more carbonate materials disposed within the interstitial regions. The body shown in FIG. 2 includes a first region 250 extends a depth from the working surface 210, where the first region includes a first carbonate material disposed in the interstitial regions of the bonded together diamond grains. A second region 255 distal from the working surface 210 extends from the first region 250, where the second region includes a second carbonate material disposed in the interstitial regions of the bonded together diamond grains. For example, in some embodiments, a first region may have magnesium carbonate disposed within the interstitial regions of the bonded together diamond grains, and a second region may have calcium carbonate disposed within the interstitial regions of the bonded together diamond grains. In other embodiments, a first region may be formed of diamond and magnesium carbonate, and a second region may be formed of diamond, magnesium carbonate and calcium carbonate. However, in yet other embodiments, an entire polycrystalline diamond body may be formed of a single type of carbonate or a uniform distribution of more than one type of carbonate disposed within the interstitial regions of the bonded together diamond grains.

Carbonate-based polycrystalline diamond bodies according to embodiments of the present disclosure may be formed by sintering multiple homogeneous layers together under high pressure high temperature (HPHT) conditions. For example, a method of making a polycrystalline diamond body may include forming multiple layers of premixed diamond particles and carbonate material, where the carbonate material is selected from an alkaline earth metal carbonate. In some embodiments, the carbonate material may include an alkali metal carbonate in addition to an alkaline earth metal carbonate. As used herein, a layer may include an amount of homogeneously premixed diamond particles and carbonate material extending a thickness and an area measured perpendicular to the thickness, where each layer of premixed material may have a weight percent ratio of diamond to carbonate that is uniform throughout the thickness and across the area of the layer. The premixed layers may be sintered together by subjecting the layers to high pressure high temperature conditions, such as pressures greater than 6 GPa and temperatures greater than 1,700° C. (3,092° F.) and within the region of diamond thermodynamic stability. For example, in some embodiments, the premixed layers may be sintered together under a pressure of 6-8 GPa and a temperature of greater than 2,000° C. (3,632° F.), or under a pressure of 8-10 GPa and a temperature of greater than 2,000° C. (3,632° F.).

Figure 3:
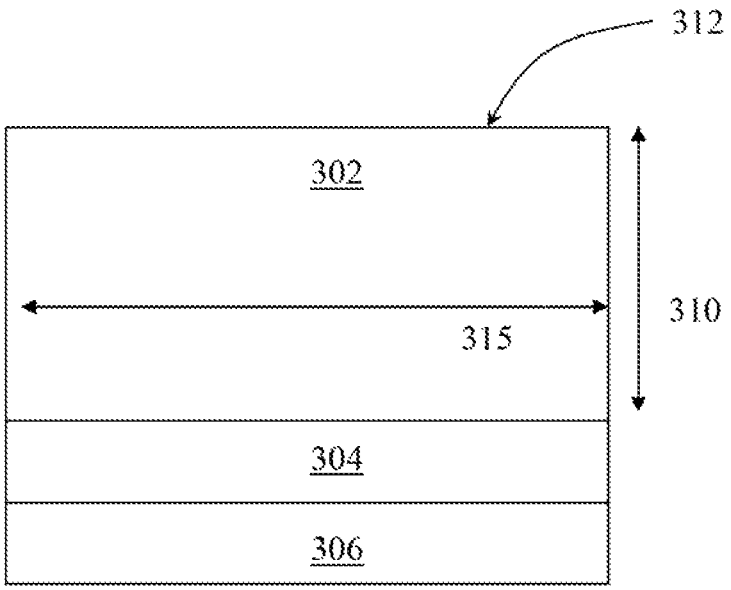
FIG. 3 shows premixed layers according to embodiments of the present disclosure.

According to embodiments of the present disclosure, each layer may have a weight percent ratio of diamond to carbonate that is different from the weight percent ratio of adjacent layers. For example, referring to FIG. 3, a cross-sectional view of multiple premixed layers 302, 304, 306 is shown, as they would appear assembled in a sintering canister or other container (not shown). As shown, the multiple premixed layers include a first outer layer 302, an inner layer 304, and a second outer layer 306 opposite from the first outer layer 302. However, in other embodiments, more than one inner layer may be disposed between two outer layers. Each layer has a homogeneous mixture of diamond particles and a carbonate material, such that the weight percent ratio of diamond to carbonate is substantially constant throughout the thickness 310 and across the area 315 (i.e., the planar dimension perpendicular to the thickness) of each layer. The weight percent ratio of layer 302 is different from the weight percent ratio of layer 304 and layer 306, and the weight percent ratio of layer 304 is different from the weight percent ratio of layer 306. For example, in some embodiments, the weight percent ratio of each of the multiple layers may decrease from the first outer layer 302 to the second outer layer 306, where the inner layer 304 has a weight percent ratio of diamond to carbonate less than that of the first outer layer 302, and the second outer layer 306 has a weight percent ratio less than that of the inner layer 304. However, in other embodiments, the weight percent ratio between adjacent layers may vary in ways other than descending order from the first outer layer to the second outer layer. Further, the first outer layer 302 shown in FIG. 3 is directionally positioned at the top of the premixed layer assembly. However, as used herein, the terms "first outer layer" and "second outer layer" are not directionally dependent and may be shown as a bottom layer, side layer, etc., depending on the orientation of the assembly. Additionally, either the first outer layer or the second outer layer may eventually form a working surface, once the premixed layers are assembled and sintered to form a polycrystalline diamond cutting element. For example, upon sintering the premixed layers in FIG. 3, the first outer layer 302 having the largest weight percent diamond and the lowest weight percent carbonate material when compared with the other premixed layers 304, 306 may form a working surface 312 that has a higher wear resistance than the remaining diamond body.

As shown, the thickness 310 of each of the layers 302, 304, 306 is substantially constant throughout the layer such that planar boundaries or interface surfaces are formed between adjacent layers. However, according to other embodiments, one or more layers may have a varying thickness such that non-planar interface surfaces or boundaries are formed. Further, premixed layers may have equal or unequal thicknesses when compared with other premixed layers. For example, as shown in FIG. 3, layer 302 may have a thickness 310 that is larger than the thicknesses of layers 304 and 306, and the thickness of layer 304 may be approximately equal to the thickness of layer 306, where each thickness is substantially constant across the layer area 315. In other embodiments, each premixed layer may have equal thicknesses or each premixed layer may have different thicknesses when compared with the thicknesses of the other layers within a layered assembly.

Further, the premixed layers 302, 304, 306 shown in FIG. 3 have equal planar dimensions perpendicular to the thickness. In such embodiments, once the layers have been sintered to form a polycrystalline diamond body, the polycrystalline diamond body may have a substantially continuous (if the final body shape is cylindrical or non-planar) or planar (if the final body shape includes intersecting planar sides) outer side surface. For example, as shown in FIG. 2, premixed layers having equal planar dimensions perpendicular to the thickness may be sintered together according to methods of the present disclosure to form a polycrystalline diamond body having a substantially continuous side surface 220. In other words, a premixed layer may extend radially from a central axis completely to what will become the outer side surface of a polycrystalline diamond body upon sintering the premixed layers.

According to some embodiments, premixed layers having equal planar dimensions perpendicular to the thickness may be formed by pouring each layer into a canister or container having a continuous or planar inner wall. For example, a mixture of an amount of diamond particles and carbonate material having a predetermined weight percent ratio of diamond to carbonate may be poured into the canister to form a first outer layer, where the first outer layer is poured to a thickness extending axially along the canister and where the inner wall of the canister defines the area (i.e., planar dimension perpendicular to the thickness) of the first outer layer. A subsequent layer may then be formed adjacent to the first outer layer by pouring a second mixture of an amount of diamond particles and carbonate material having a predetermined weight percent ratio of diamond to carbonate (which may be different from the weight percent ratio of diamond to carbonate of the first outer layer) into the canister and adjacent to the first outer layer. The second mixture may be poured into the canister to a thickness equal to or different than the thickness of the first outer layer, where the inner wall of the canister defines the area of the subsequent layer. A second outer layer (or additional subsequent layers in embodiments having more than three premixed layers) having a predetermined weight percent ratio of diamond to carbonate (which may be different than the weight percent ratio of the subsequent layer and optionally also different than the weight percent ratio of the first outer layer) may then be poured into the canister adjacent to the subsequent layer and up to a thickness equal to or different than the thicknesses of the first outer layer and the subsequent layer, where the area of the second outer layer is defined by the inner wall shape of the canister.

Figure 4:
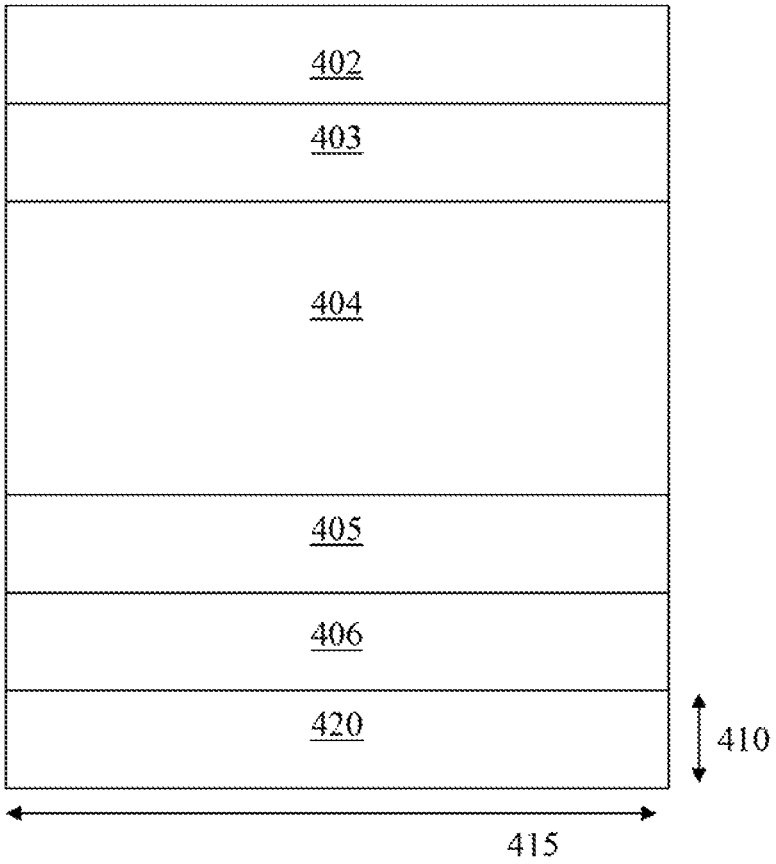
FIG. 4 shows premixed layers and an infiltration layer according to embodiments of the present disclosure.

Referring now to FIG. 4, another embodiment of the present disclosure is shown, where an infiltration layer is placed adjacent to an outer premixed layer. As used herein, an infiltration layer refers to a layer of carbonate material placed adjacent to a premixed layer, where during the sintering process, the carbonate material of the infiltration layer infiltrates at least into the adjacent premixed layer. For example, as shown in FIG. 4, multiple premixed layers 402, 403, 404, 405, and 406 each have a predetermined weight percent ratio of diamond to carbonate. An infiltration layer 420 is formed adjacent to an outer layer 406. Each layer, including the premixed layers 402, 403, 404, 405, 406 and the infiltration layer 420, has a thickness and an area extending along the dimensional plane perpendicular to the thickness, where the thickness is uniform across the entire area. As shown, infiltration layer 420 has a thickness 410 and an area 415. Premixed layers 402, 403, 404, 405, and 406 may each have a thickness equal to or different than the thickness of the infiltration layer 420. For example, a layer having a comparatively large amount of premixed carbonate material, such as inner layer 404 in FIG. 4, may have a thickness larger than layers having a comparatively large amount of premixed diamond material, such as layers 402, 403, 405 and 406 in FIG. 4. Further, each of the premixed layers 402, 403, 404, 405, 406 may have an area equal to the area of the infiltration layer 420 such that the infiltration layer 420 and the premixed layers 402, 403, 404, 405, 406 are aligned.

Referring still to FIG. 4, the weight percent ratio of diamond to carbonate between adjacent layers is different, e.g., the weight percent ratio of layer 402 is different from the weight percent ratio of layer 403, the weight percent ratio of layer 403 is different from the weight percent ratio of layer 404, etc. While the weight percent ratio of diamond to carbonate between adjacent layers may be different, non-adjacent layers may have the same or different weight percent ratio of diamond to carbonate. Further, the weight percent ratio of each of the multiple layers may increase from an inner layer to a first outer layer and a second outer layer. For example, as shown in FIG. 4, an inner layer 404 may have a predetermined weight percent ratio of diamond to carbonate. Adjacent layers 403 and 405 may have a weight percent ratio of diamond to carbonate that is larger than the weight percent ratio of the inner layer 404 (i.e., the adjacent layers 403, 405 may have a comparatively larger amount of diamond and smaller amount of carbonate throughout the premixed layers than that in the inner layer 404), where the adjacent layers 403 and 405 may have approximately equal weight percent ratios or different weight percent ratios of diamond to carbonate. For example, in embodiments where the adjacent layer 403 and 405 have approximately equal weight percent ratios, the layers 403, 405 may be formed from the same powder mixture of diamond and carbonate. Further, the first outer layer 402 and the second outer layer 406 may have a weight percent ratio of diamond to carbonate that is larger than the adjacent layers 403 and 405 (and thus also larger than the inner layer 404), where the first and second outer layers 402 and 406 may have approximately equal weight percent ratios or different weight percent ratios of diamond to carbonate.

In addition to varying the amount of carbonate material mixed with diamond in each layer, the layers 402, 403, 404, 405, 406 may include the same or different types of carbonate material mixed with diamond. For example, the inner layer 404 may be formed of a premixed composition of only diamond, magnesium carbonate and calcium carbonate, while the adjacent layers 403, 405 and outer layers 402, 406 may be formed of a premixed composition of only diamond and magnesium carbonate. Other premixed layers, such as inner layers, may be formed of diamond and both an alkali metal carbonate and alkaline earth metal carbonate. Further, premixed layers of the present disclosure may be described as being formed only of diamond and one or more carbonates; however, such compositions may also include minor impurities.

Figure 5:
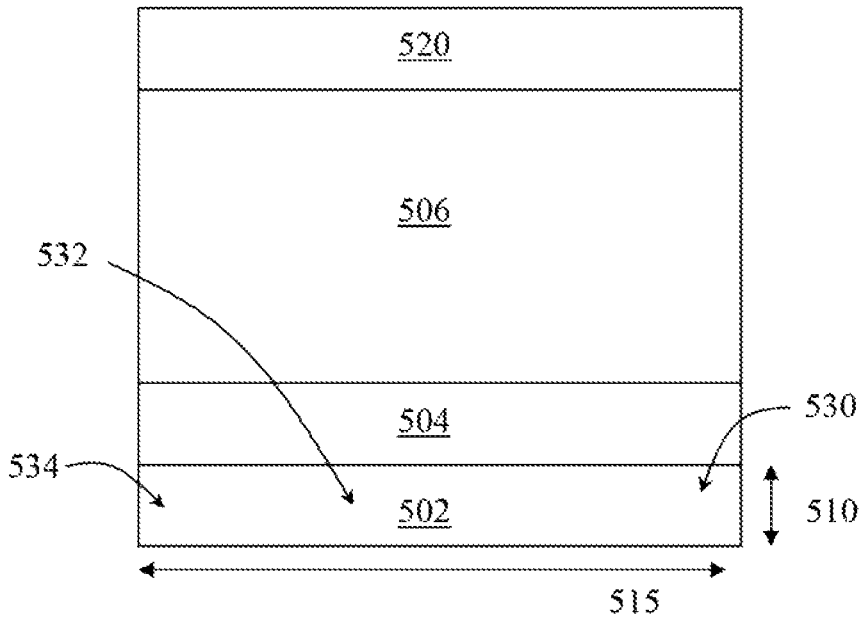
FIG. 5 shows premixed layers and an infiltration layer according to embodiments of the present disclosure.
Figure 6:
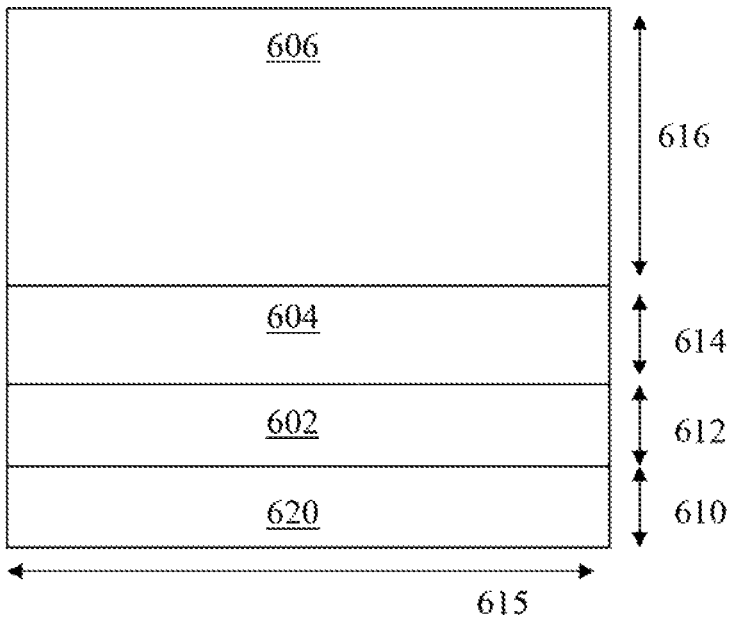
FIG. 6 shows premixed layers and an infiltration layer according to embodiments of the present disclosure.

Referring now to FIGS. 5 and 6, other embodiments of premixed layers are shown. As shown in FIG. 5, a first outer layer 502 may have a thickness 510, an area 515 extending the planar dimension perpendicular to the thickness, where the thickness 510 is uniform across the area 515, and a weight percent ratio of diamond to carbonate, where the weight percent ratio is substantially constant throughout the first outer layer 502. Particularly, a substantially constant weight percent ratio of diamond to carbonate throughout the layer means that a weight percent ratio of diamond to carbonate measured at one region of the layer is approximately equal to a weight percent ratio of diamond to carbonate at other regions of the layer. For example, as shown in FIG. 5, the weight percent ratio of diamond to carbonate measured at a region 530 adjacent to an outer surface of the outer layer 502 is approximately equal to the weight percent ratio of diamond to carbonate measured at an inner region 532 of the outer layer 502, and is approximately equal to the weight percent ratio of diamond to carbonate measured at a second region 534 adjacent to an outer surface of the outer layer 502. In other words, the weight percent ratio is substantially uniform across the thickness 510 and area 515 of the layer. However, in other embodiments, the weight percent ratio may not be uniform throughout a layer, e.g., the weight percent ratio may vary (by regions or by gradient) across the thickness or across the area of a layer. For example, one or more premixed layers may have a higher concentration of carbonate material (i.e., a low weight percent ratio of diamond to carbonate) at or near the center or core of the layer, while a region at or near the outer surface of the layer may have a comparatively lower concentration of carbonate material (i.e., a high weight percent ratio of diamond to carbonate).

An inner layer 504 is disposed adjacent to the first outer layer 502 and also has a weight percent ratio of diamond to carbonate that is substantially constant throughout the layer. The weight percent ratio of the inner layer 504 may be less than the first outer layer 502, where a higher concentration of diamond is premixed in the first outer layer 502 than in the inner layer 504. A second outer layer 506 is disposed adjacent to the inner layer 504 and opposite from the first outer layer 502, where the second outer layer 506 has a weight percent ratio different from the weight percent ratio of the inner layer 504. The weight percent ratio of the second outer layer 506 may be less than the weight percent ratio of the inner layer 504 (and thus also less than the weight percent ratio of the first outer layer 502. However, in other embodiments, the weight percent ratio of the second outer layer may be equal to or different from the weight percent ratio of the first outer layer and may be greater than or less than the weight percent ratio of the inner layer. Further, an infiltration layer 520 may be disposed adjacent to the second outer layer 506, opposite from the inner layer 504. The infiltration layer 520 may be formed of a carbonate material, such as magnesium carbonate.

As shown in FIG. 6, a first outer layer 602 may have a thickness 612, an area 615 extending in the planar dimension perpendicular to the thickness, where the thickness 612 is uniform across the area 615, and a weight percent ratio of diamond to carbonate, where the weight percent ratio is substantially constant throughout the first outer layer 602. An inner layer 604 is disposed adjacent to the first outer layer 602 and also has a weight percent ratio of diamond to carbonate that is substantially constant throughout the layer. The weight percent ratio of the inner layer 604 is less than the first outer layer 602. A second outer layer 606 is disposed adjacent to the inner layer 604 and opposite from the first outer layer 602, where the second outer layer 606 has a weight percent ratio less than the weight percent ratio of the inner layer 604 (and thus also lower than the first outer layer 602). However, according to other embodiments, the weight percent ratio of the second outer layer 606 may be equal to or different from the weight percent ratio of the first outer layer 602 and may be greater than or less than the weight percent ratio of the inner layer 604.

Further, the thicknesses of each layer shown in FIG. 6 may be equal or different. For example, as shown, the first outer layer 602 may have a thickness equal to the thickness 614 of the inner layer 604, and the second outer layer 606 may have a thickness 616 greater than the thicknesses 612, 614 of the inner layer 604 and first outer layer 602. The infiltration layer 620 may also have a thickness 610 equal to or different than the premixed layers 602, 604, 606. For example, as shown in FIG. 6, the infiltration layer 620 may have a thickness 610 approximately equal to the thickness 612 of the first outer layer 602 and less than the thickness 616 of the second outer layer 606. The infiltration layer 620 may be formed of a carbonate material, such as magnesium carbonate.

Infiltration layers may be positioned adjacent to the first outer layer or the second outer layer of a premixed layer assembly. For example, the infiltration layer 520 shown in FIG. 5 is disposed adjacent to the second outer layer 506 which has the lowest weight percent ratio of diamond to carbonate (i.e., a comparatively large amount of carbonate material). However, in other embodiments, an infiltration layer may be disposed adjacent to a layer having the highest weight percent ratio of diamond to carbonate. For example, as shown in FIG. 6, an infiltration layer 620 may be disposed adjacent to the first outer layer 602, which has a higher weight percent ratio than that of layers 604 and 606.

Figure 10:
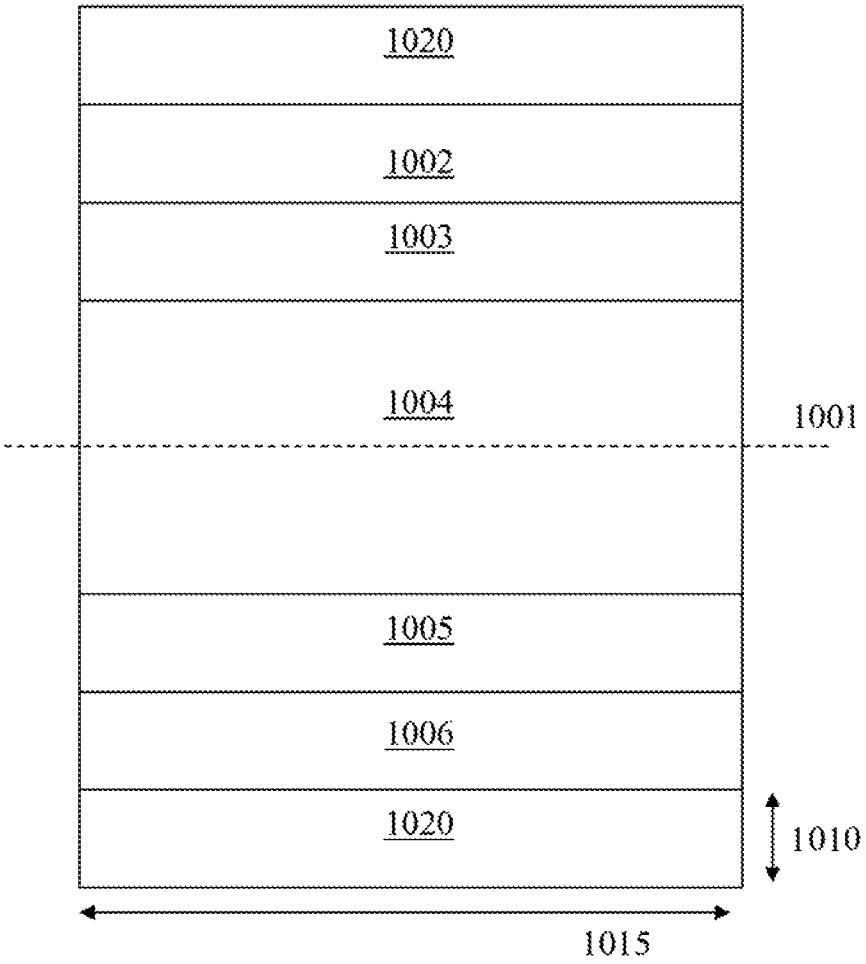
FIG. 10 shows premixed layers and two infiltration layers according to embodiments of the present disclosure.

In yet other embodiments, an infiltration layer may be positioned adjacent to both the first outer layer and the second outer layer of a premixed layer assembly. For example, referring to FIG. 10, an embodiment of the present disclosure is shown, where an infiltration layer is placed adjacent to the outer premixed layers. As shown, multiple premixed layers 1002, 1003, 1004, 1005, and 1006, each having a predetermined weight percent ratio of diamond to carbonate, are layered together to form a premixed layer assembly. An infiltration layer 1020 is formed adjacent to the outer layers 1002 and 1006. Each layer, including the premixed layers 1002, 1003, 1004, 1005, 1006 and the infiltration layer 1020, has a thickness and an area extending along the dimensional plane perpendicular to the thickness, where the thickness is uniform across the entire area. As shown, the infiltration layers 1020 each have a thickness 1010 and an area 1015. Premixed layers 1002, 1003, 1004, 1005, and 1006 may each have a thickness equal to or different than the thickness of the infiltration layer 1020. The weight percent ratio of diamond to carbonate may decrease or increase from the outer layers 1002, 1006 toward the inner layer 1004, such that the premixed layer assembly, including the infiltration layers 1020, is symmetric in diamond to carbonate composition with respect to a lateral plane 1001. However, in other embodiments, infiltration layers may be positioned adjacent to both the first and second outer layers of a premixed layer assembly without diamond to carbonate composition symmetry. For example, premixed layers may have a decreasing or increasing weight percent ratio of diamond to carbonate from a first outer layer to a second outer layer, where an infiltration layer is positioned adjacent to both the first and second outer layers. In other embodiments, premixed layers may have a decreasing or increasing weight percent ratio of diamond to carbonate from an outer layer to an inner layer, where an infiltration layer is positioned adjacent to both of the outer layers.

Diamond particles used in the diamond and carbonate mixtures may include, for example, natural or synthetic diamond, and may have varying particle sizes, depending on the end use application. For example, diamond particles may range in size from submicrometer to 100 micrometers (fine and/or coarse sized), and from 1-5 micrometers in some embodiments, from 5-10 micrometers in other embodiments, and from 15-20 micrometers in yet other embodiments. Further, diamond particles may have a monomodal distribution (having the same general average particle size) or a multimodal distribution (having different volumes of different average particle sizes). Carbonate materials that may be used in the diamond and carbonate mixtures forming premixed layers of the present disclosure (and as an infiltration material in some embodiments) may include alkali metal carbonates and/or alkaline earth metal carbonates, such as, for example, magnesium carbonate or calcium carbonate. The carbonate material may have a particle size ranging from submicron to 100 micrometers and from 0.1 to 30 micrometers in some embodiments. Further, different premixed layers may have different particle size ranges. For example, center layers can have tougher, coarse grade diamond, while the carbonate material may have a substantially uniform particle size range throughout the premixed layer assembly.

Further, according to embodiments of the present disclosure, the weight percent of carbonate in a premixed layer may range from greater than 0 percent carbonate by weight to less than about 20 percent carbonate by weight, and the weight percent of diamond in a premixed layer may range from greater than 80 percent diamond by weight to less than 99 percent diamond by weight. For example, some embodiments may include a diamond and carbonate mixture having a weight percent ratio of diamond to carbonate that includes greater than about 90 percent by weight of diamond and less than about 10 percent by weight of carbonate material. In another embodiment, one or more premixed layers may have a weight percent ratio of diamond to carbonate that includes greater than 95 percent by weight diamond and less than 5 percent by weight carbonate. For example, in some embodiments, one or both outer layers of a premixed layer assembly may have 4 percent or less by weight of carbonate material and 96 percent or more by weight diamond. In other embodiments, one or both outer layers of a premixed layer assembly may have 2 percent or less by weight of carbonate material and 98 percent or more by weight diamond, depending on grain size.

Figure 7:
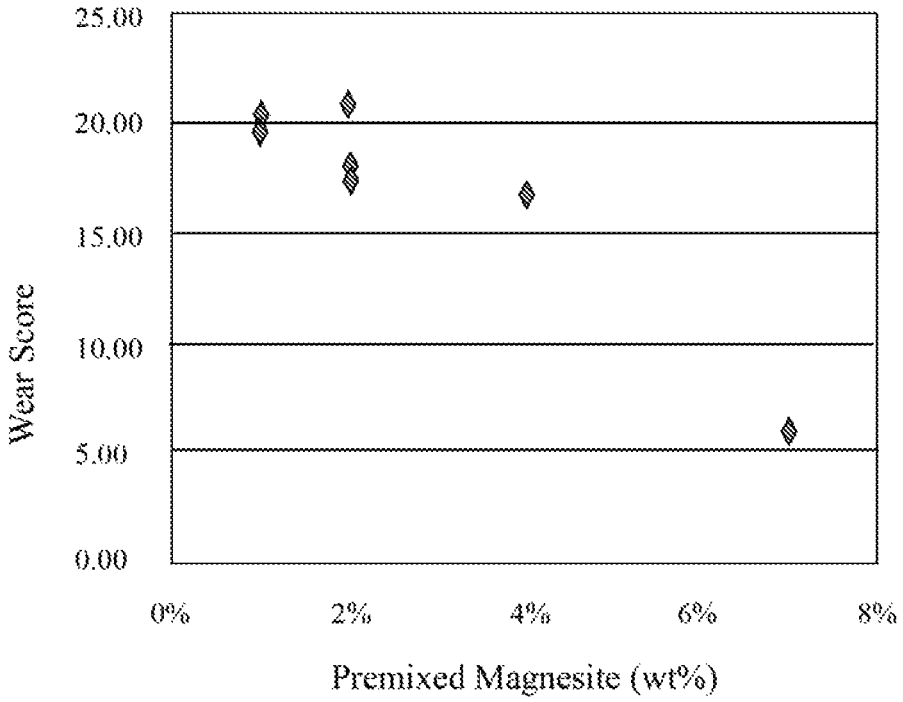
FIG. 7 shows a comparison of wear resistance to the amount of premixed magnesium carbonate.

As shown in FIG. 7, a diamond and carbonate mixture having a lower concentration of a carbonate material (magnesium carbonate is shown), and thus a higher concentration of diamond, may result in the sintered mixture having an increased wear resistance, i.e., the formed polycrystalline diamond body may have a higher wear score. According to some embodiments, a polycrystalline diamond body may be formed with one or more premixed layers including less than 2 percent by weight carbonate as at least one outer layer and one or more premixed layers including greater than 2 percent by weight carbonate as at least one inner layer, thereby providing at least one outer surface of the sintered polycrystalline diamond body with an increased wear resistance. For example, in embodiments having a cutting element, such as for use on a down hole drilling tool, formed from the polycrystalline diamond material of the present disclosure, a working surface of the cutting element (i.e., the outer surface of the cutting element that contacts and cuts the formation being cut) may be formed from a premixed layer having less than 4 percent by weight carbonate with the remainder diamond, and the remaining portions of the cutting element may be formed from one or more premixed layers having greater than 4 percent by weight carbonate with the remainder diamond, such that the working surface has a higher wear resistance than the wear resistance of the remaining cutting element.

According to embodiments of the present disclosure, premixed layers of diamond and one or more carbonate materials may be sintered under high pressure high temperature conditions to form a polycrystalline diamond body. High pressure high temperature conditions may include pressures greater than 6 GPa and temperatures greater than 1,700° C. Further, as described above, an infiltration layer made of one or more carbonates of an alkali or alkaline earth metal may be positioned adjacent to one of the premixed layers, where during the sintering process, the carbonates of the infiltration layer infiltrate a depth into the premixed layers. The depth of infiltration may depend on the composition of the premixed layers and the sintering conditions, for example.

Figure 8:
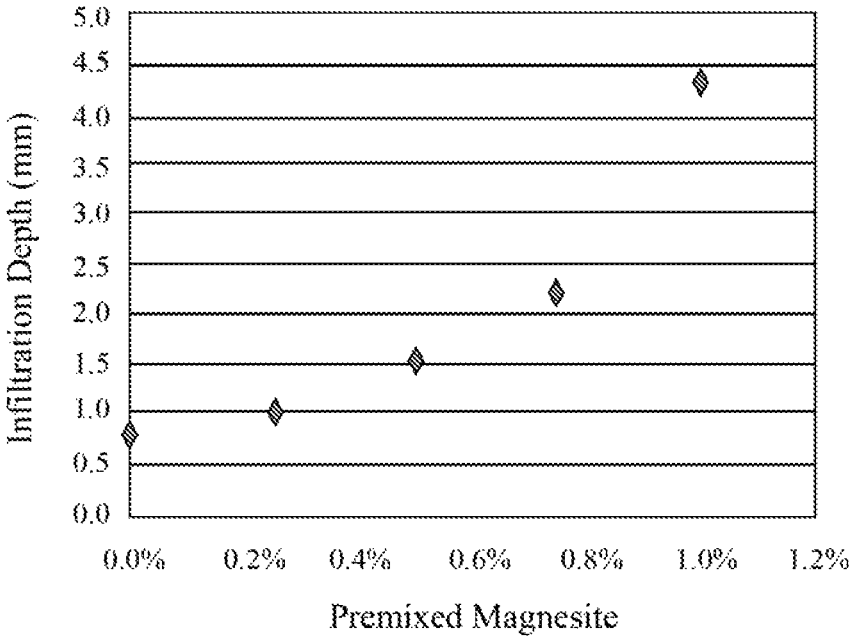
FIG. 8 shows a comparison of infiltration depth to the amount of premixed magnesium carbonate.

For example, FIG. 8 shows the relationship between the infiltration depth of a magnesium carbonate infiltrant and a premixed amount of magnesium carbonate in premixed layers during sintering conditions of 7.7 GPa and 2,300° C. As shown, the infiltration depth increases as the amount of carbonate within the premixed layers increases. The specific relationship between infiltration and carbonate amount will vary by grain size of the diamond.

Polycrystalline diamond bodies made according to embodiments of the present disclosure may be used as cutting elements on down hole cutting tools, such as drill bits. For example, down hole tools of the present disclosure may have a body, a plurality of blades extending from the body, and at least one polycrystalline diamond cutting element according to embodiments of the present disclosure disposed on the plurality of blades. The at least one polycrystalline diamond cutting element is disposed on the blades such that a working surface, i.e., a surface that contacts and cuts the formation being drilled, is positioned at a leading face of the blade and faces in the direction of the drill's rotation. The polycrystalline diamond cutting element may include a polycrystalline diamond body made of a plurality of bonded together diamond grains forming a matrix phase, a plurality of interstitial regions interposed between the bonded together diamond grains, and a carbonate material disposed within the interstitial regions, where the carbonate material is selected from at least one of an alkali metal carbonate and/or an alkaline earth metal carbonate. Further, as described above, the polycrystalline diamond body may have a height measured between a working surface and a non-working surface of greater than 4 mm.

A polycrystalline diamond cutting element may be rotatably secured to the blade, such as disclosed in U.S. Pat. No. 8,091,655, or may be mechanically secured to the blade, such as disclosed in U.S. Provisional Patent Application No. 61/599,665. In yet other embodiments, a polycrystalline diamond cutting element of the present disclosure may be brazed within a pocket formed in a blade or body of a down hole cutting tool.

As described above, a polycrystalline diamond body according to embodiments of the present disclosure has a plurality of bonded together diamond grains forming a matrix phase, a plurality of interstitial regions interposed between the bonded together diamond grains, and a carbonate material disposed within the interstitial regions, where the carbonate material is selected from at least one of an alkali metal carbonate and/or an alkaline earth metal carbonate. In such embodiments, the polycrystalline diamond material may be formed without the use of a metal solvent catalyst so that the finished polycrystalline diamond body does not contain any metal solvent catalyst.

Forming a carbonate-based polycrystalline diamond body according to methods disclosed herein allows for the formation of a thick solid polycrystalline diamond. For example, a polycrystalline diamond body of the present disclosure may include a working surface, a side surface, and a non-working surface distal from the working surface, where a distance between the working surface and non-working surface, or height, is greater than 4 mm. In some embodiments, a polycrystalline diamond body may have a height of greater than 6 mm.

Figure 9:
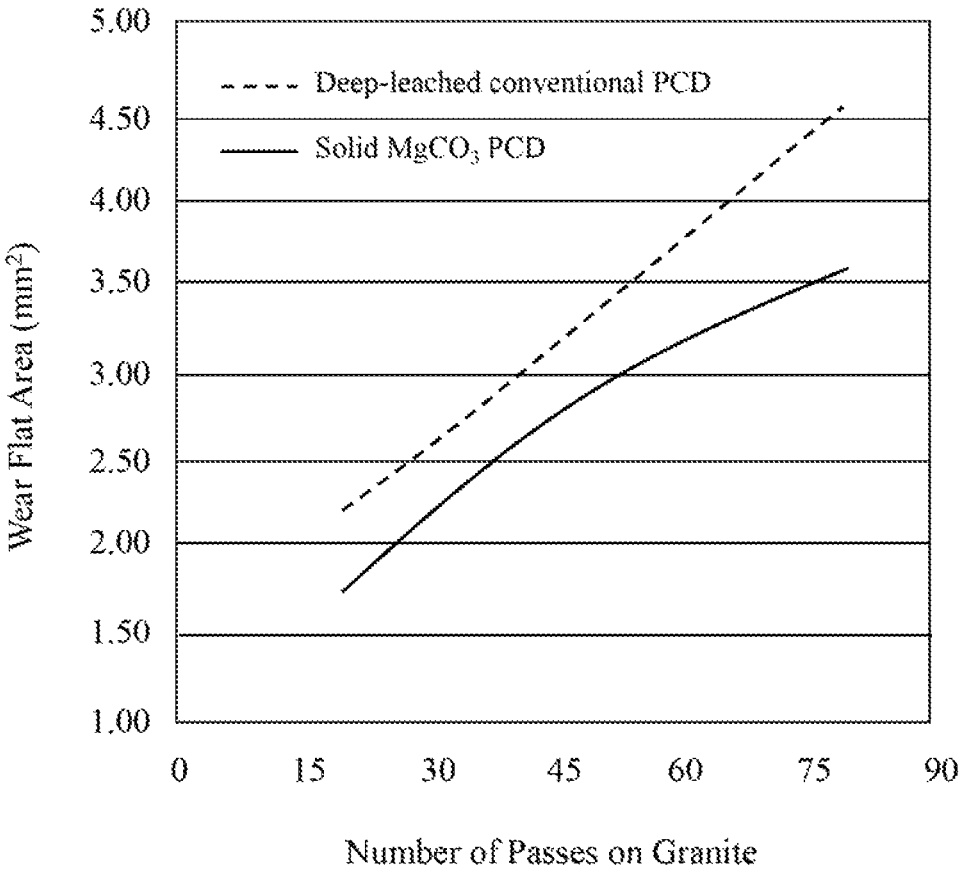
FIG. 9 shows a comparison of wear resistance between deep-leached conventional polycrystalline diamond and carbonate-based polycrystalline diamond material of the present disclosure.

Further, forming carbonate-based polycrystalline diamond material according to methods disclosed herein allows for the formation of a polycrystalline diamond body having increased wear resistance when compared with conventionally formed and leached polycrystalline diamond (i.e., polycrystalline diamond body formed with a metal solvent catalyst and then a portion of the catalyst material removed). For example, FIG. 9 shows a comparison of the wear resistance between deep-leached conventional polycrystalline diamond and carbonate-based polycrystalline diamond material of the present disclosure. Particularly, carbonate-based polycrystalline diamond material according to embodiments of the present disclosure was formed by sintering premixed layers of diamond and magnesium carbonate under conditions of 7.2 GPa and 2,300° C. (4,172° F.). The carbonate-based polycrystalline diamond and a deep leached conventionally formed polycrystalline diamond material were formed into cutting elements and tested on a granite workpiece. As shown, increased amounts of wear (larger wear flats areas) occurred in the deep-leached conventionally formed polycrystalline diamond cutting element than in the carbonate-based polycrystalline diamond cutting element.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A polycrystalline diamond construction, comprising:

a polycrystalline diamond body comprising a plurality of bonded together diamond grains forming a matrix phase, a plurality of interstitial regions interposed between the bonded together diamond grains, and a carbonate material disposed within the interstitial regions, the carbonate material comprising an alkaline earth metal carbonate, wherein the polycrystalline diamond body is formed from a plurality of layers of pre-mixed diamond particles and the carbonate material without a transition metal catalyst, at least one of the plurality of layers having a weight percent ratio of diamond to carbonate that is different from an adjacent layer.

2. The construction of claim 1, wherein the carbonate material further comprises an alkali metal carbonate.

3. The construction of claim 1, wherein the carbonate material comprises at least one of magnesium carbonate or calcium carbonate.

4. The construction of claim 1, wherein the polycrystalline diamond body further comprises a height measured between a working surface and a non-working surface, and the height is greater than 4 mm.

5. The construction of claim 1, further comprising a first region extending a depth from a working surface, wherein the first region comprises magnesium carbonate disposed in the interstitial regions.

6. The construction of claim 5, further comprising a second region distal from the working surface, wherein the second region comprises calcium carbonate disposed in the interstitial regions.

7. A downhole tool, comprising:

a body;

a plurality of blades extending from the body; and at least one polycrystalline diamond cutting element on at least one of the plurality of blades, wherein the polycrystalline diamond cutting element comprises:

a polycrystalline diamond body comprising a plurality of bonded together diamond grains forming a matrix phase, a plurality of interstitial regions interposed between the bonded together diamond grains, and a carbonate material disposed within the interstitial regions, the carbonate material comprising an alkaline earth metal carbonate and the body having a height measured between a working surface and a non-working surface, the height being greater than 4 mm formed from a plurality of layers of premixed diamond particles and the carbonate material without a transition metal catalyst, at least one of the plurality of layers having a weight percent ratio of diamond to carbonate that is different from an adjacent layer.

8. The downhole tool of claim 7, wherein the polycrystalline diamond cutting element is rotatably secured to the blade.

9. The downhole tool of claim 7, wherein the polycrystalline diamond cutting element is mechanically secured to the blade.

10. The downhole tool of claim 7, wherein the carbonate material comprises at least one of magnesium carbonate or calcium carbonate.

11. The construction of claim 1, wherein each of the plurality of layers comprises homogeneously premixed diamond particles and carbonate material extending a thickness and an area measured perpendicular to the thickness, where each layer has a weight percent ratio of diamond to carbonate that is uniform throughout the thickness and across the area of the layer.

12. The construction of claim 1, wherein the polycrystalline diamond body further comprises a height measured between a working surface and a non-working surface, and the height is greater than 2 mm.

13. A polycrystalline diamond construction, comprising:

a polycrystalline diamond body comprising a plurality of bonded together diamond grains forming a matrix phase, a plurality of interstitial regions interposed between the bonded together diamond grains, and a carbonate material disposed within the interstitial regions, the carbonate material comprising an alkaline earth metal carbonate, the polycrystalline diamond body comprising:

a first region extending a depth from a working surface, wherein the first region comprises magnesium carbonate disposed in the interstitial regions; and a second region distal from the working surface, wherein the second region comprises calcium carbonate disposed in the interstitial regions.

* * * * *